United States Patent [19]

Zimmer

[11] 4,063,769

[45] Dec. 20, 1977

[54] BALL RETRIEVER

[76] Inventor: Ronald Zimmer, 115 N. Benton Road, West Frankfort, Ill. 62896

[21] Appl. No.: 727,020

[22] Filed: Sept. 27, 1976

[51] Int. Cl.[2] ..... A63B 47/02

[52] U.S. Cl. ..... 294/19 A

[58] Field of Search ..... 294/19 R, 19 A, 20, 294/33, 99 R; 56/328 R, 332; 267/167, 168; 273/32 R, 32 B, 32 D, 32 F, 162 R, 162 E, 162 F

[56] References Cited

U.S. PATENT DOCUMENTS

| | | | |
|---|---|---|---|
| 713,672 | 11/1902 | Oliver | 294/19 A |
| 2,203,170 | 6/1940 | MacDonald | 294/19 A |
| 2,810,252 | 10/1957 | Kelly | 294/19 A X |
| 3,258,286 | 6/1966 | Coward | 294/19 A |
| 3,558,170 | 1/1971 | Stanworth | 294/19 A |

*Primary Examiner*—Johnny D. Cherry

*Attorney, Agent, or Firm*—Clarence A. O'Brien; Harvey B. Jacobson

[57] ABSTRACT

An upstanding tubular member is provided and the lower end of the tubular member is open and defines a downwardly opening mouth of generally circular cross section. An elongated coil spring is supported from the lower end of the tubular member in position extending across the mouth from one side thereof to the other with the spring spaced to one side of the diameter of the mouth paralleling the spring. The mouth, other than the spring, is at least substantially free of obstructions to the passage of a ball upwardly therethrough of a diameter at least slightly greater than the distance between the spring and the side of the mouth on the other side of the aforementioned diameter thereof. The upper end portion of the tubular member is secured upwardly through the central portion of the bottom of an upwardly opening receptacle and the upper side walls of the receptacle are braced relative to the upper end of the tube and the upper end of the receptacle includes a bail-type handle.

5 Claims, 7 Drawing Figures

BALL RETRIEVER

BACKGROUND OF THE INVENTION

Many people practice the game of golf today with plastic practice balls. Ball retrievers presently on the market are designed to receive regulation balls which are much heavier and more substantial than the light plastic practice balls. Accordingly, there is a need for a retriever that can be used effectively to retrieve lightweight practice balls, or the heavier regulation golf balls.

BRIEF DESCRIPTION OF THE INVENTION

The present invention relates to a ball retriever, and particularly to a retriever for lightweight plastic practice golf balls, and also regulation golf balls.

The principal objective of the invention is to provide a ball retriever that can be used equally effective for the pick-up of plastic practice balls, or regulation golf balls by the simple adjustment of a spring assembly; the adjustment being made quite easily and within a matter of seconds.

Another objective of my invention is to provide a device of one piece construction of plastic material, with the exception of the spring assembly which consists of two small segments of expansion springs.

Still another object of my invention is to provide a ball retriever devoid of any special exits, such as zipper closures for the return of the retrieved balls to the ground, the invention including with an open top for the ease of emptying the retrieved balls. The user need only invert the device to empty its contents.

A final objective of my invention is to provide a most practical and functional device at a minimum of expense to the consumer.

I accomplish these objects by such design and arrangement of parts as will become evident upon the close examination of the following specification and claims.

In the drawings similar characters of reference indicate corresponding parts in the several views.

DETAILED DESCRIPTION OF THE INVENTION

Figure 1:
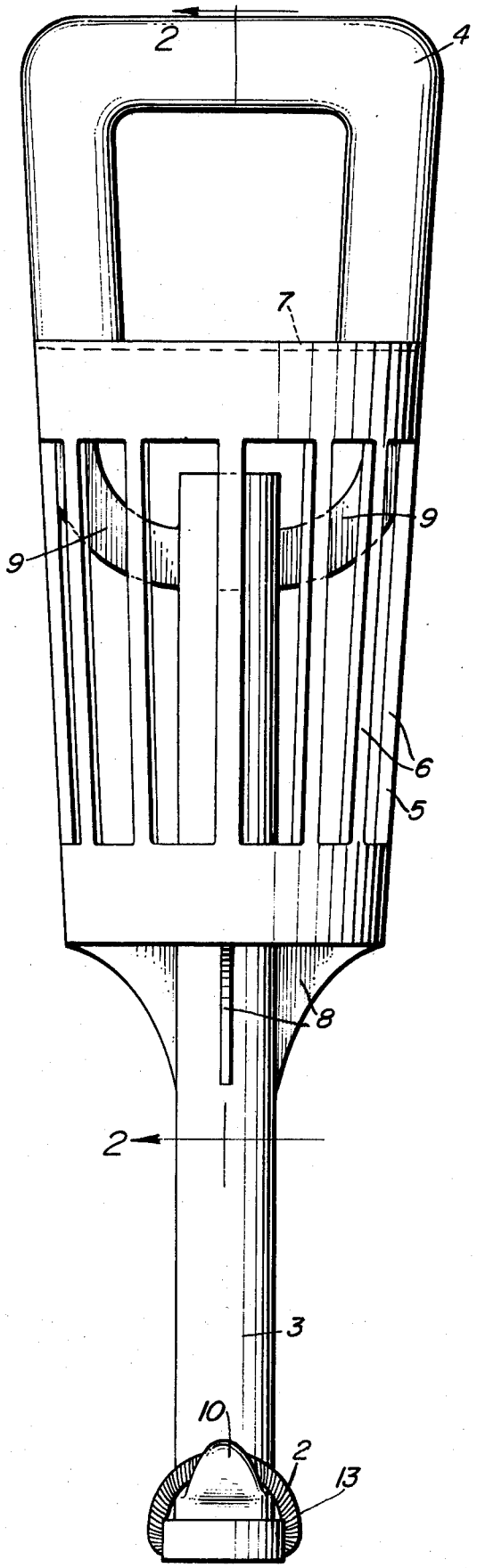
FIG. 1 is a side elevational view of the device as ready for use.
Figure 2:
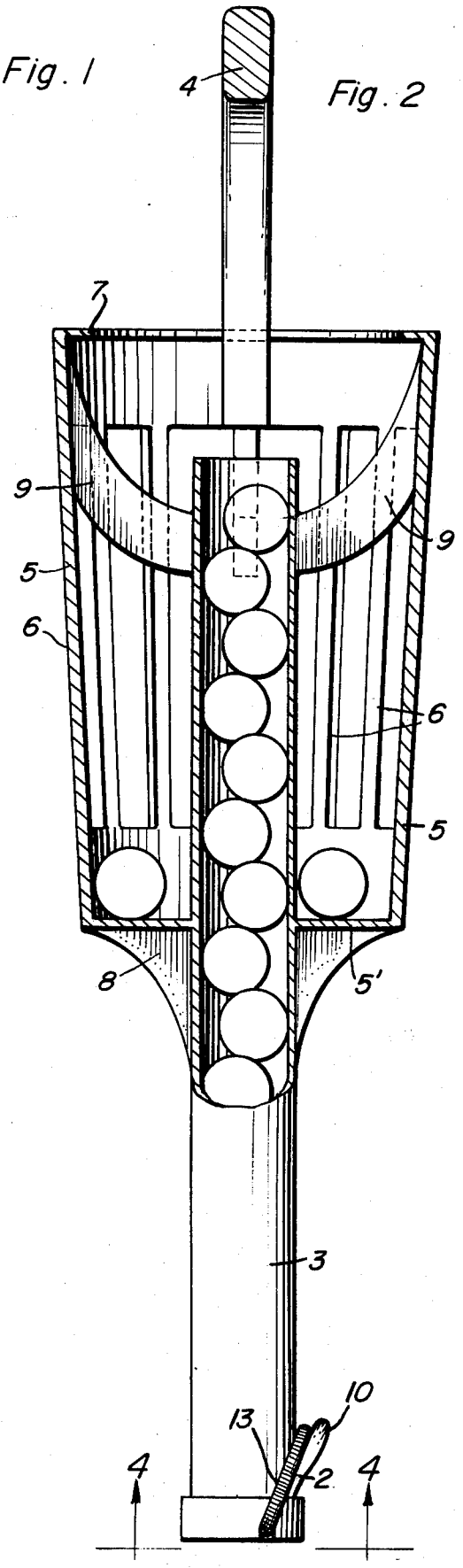
FIG. 2 is a vertical sectional view taken substantially upon the plane indicated by the section line 2—2 of FIG. 1.
Figure 3:
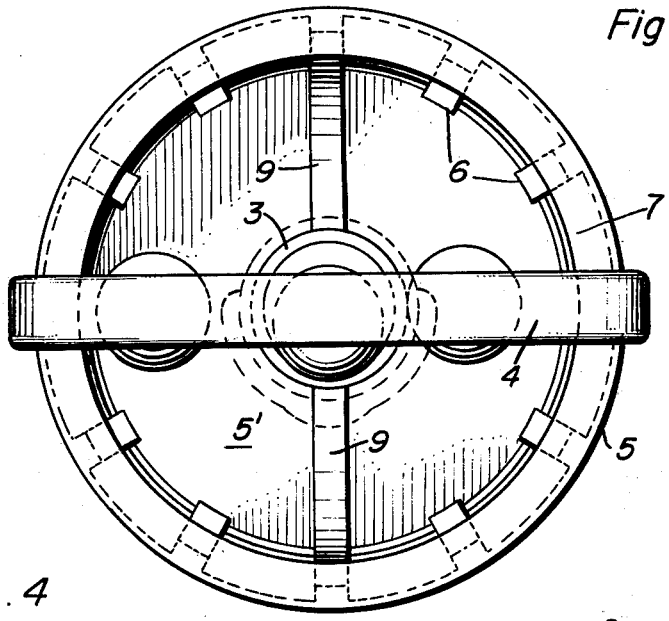
FIG. 3 is a top plan view.
Figure 4:
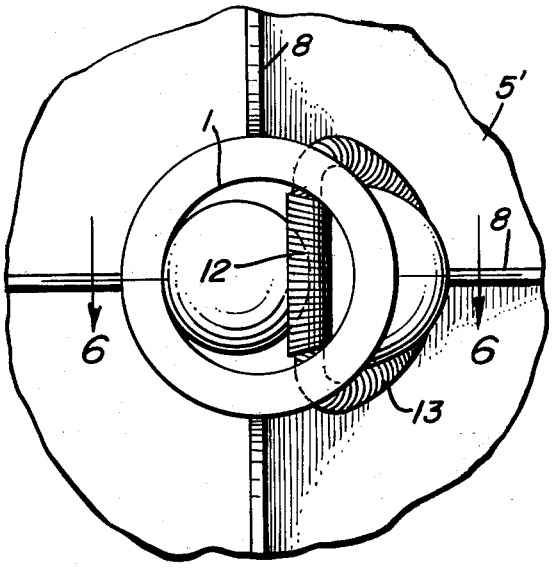
FIG. 4 is an enlarged fragmentary bottom view.
Figure 5:
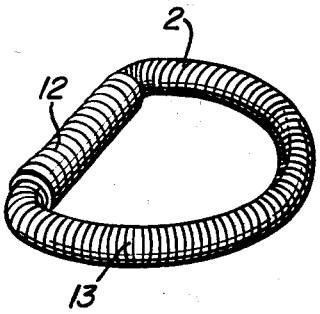
FIG. 5 is a perspective view of the coil spring structure of the invention.
Figure 6:
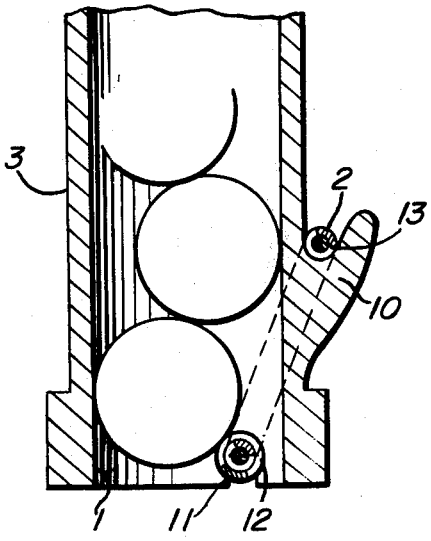
FIG. 6 is an enlarged fragmentary sectional view taken substantially upon the plane indicated by the section line 6—6 of FIG. 5.
Figure 7:
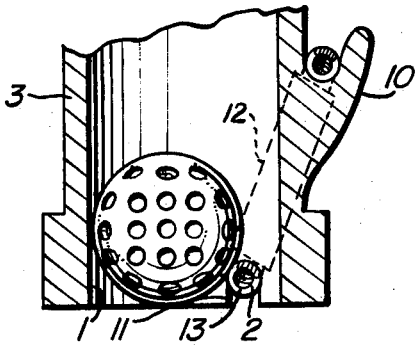
FIG. 7 is a view similar to FIG. 6, but illustrating a different portion of the spring structure extending across the mouth of the apparatus.

The invention is basically composed of two parts. These parts comprises one molded plastic piece, and one novel spring assembly. In relation to the drawings, and the description thereof, I will be referring to various areas of the plastic piece as though it were made of several parts.

Referring now to the characters of reference on the drawing, the device comprises a ball receiving chamber 1 of sufficient diameter to allow the balls to engage the spring assembly 2, and thus pass into the barrel 3.

The barrel 3 comprises the upper section of the receiving chamber 1, and is designed of adequate length to assure that the handle 4 of the device is located in a comfortable operating height for the user. The upper part of the barrel 3 is open so that as balls stack up beyond the holding capacity of the barrel 3, they will drop out of the upper opening of the barrel 3 into the basket 5.

The basket 5 is made up of twelve vertical columns 6 evenly spaced about the barrel 3, and of such width that open space between the columns is smaller than the width of a golf ball. The diameter of the basket 5 is large enough to allow retrieved balls to fill evenly about the barrel 3. The diameter of the top of the basket 5 is slightly larger than the lower diameter. This difference aids in keeping the retrieved balls in the basket 5 while the device is placed in a position parallel to the ground. The basket 5 also has a narrow retaining rim 7 at its top. This narrow rim 7 also helps in keeping the retrieved balls in the basket 5 while the device is resting in a position parallel to the ground.

The bottom 5' of the basket 5 is molded to the barrel 3, and reinforced by four reinforcement supports 8 which are equally spaced about the barrel 3.

The upper section of the basket 5 is supported about the barrel 3 by two cross supports 9 and by the handle 4 which also acts as a support from the basket 5 to the barrel 3.

For purposes of design, the upper and lower regions of the basket 5 are solidly enclosed while the section between these regions is left partially open between the vertical supports.

The handle 4 extends outward on two sides from near the top of the barrel 3, connects two sides of the basket 5 as a support, and extends further upward above and across the basket 5, to serve as a handle 4 for the device.

A spring support 10 is located near the lower end of the barrel 3 and on the side nearest the placement area for the spring assembly 2 as it extends across the receiving chamber 1. This spring support 10 extends outward and upward from the barrel 3 sufficient distance to function as a support that will place some tension on the spring assembly 2 when it is stretched in place. Its top is concavely rounded downwardly to seat either segment of the spring assembly 2.

Two small slots or notches 11 are transversely aligned to one side of the center of the receiving chamber 1 and serve as a stabilizer for that part of the spring assembly 2 which is positioned across the receiving chamber 1. These slots 11 are just a little larger than the diameter of the smaller size spring segment of the spring assembly 2, and are located to one side of the receiving chamber 1. The notches extend upward from the bottom of the chamber 1 just a little more than the diameter of the smaller size spring segment. This allows the spring assembly 2 to be in an effective position to engage the ball, and allow it to pass into the barrel 3.

Two sections of expansion springs, different in length and diameter, make up the spring assembly 2. The spring segment 12 of larger diameter (meaning the diameter of the spring size, and not the wire size) is slipped over the smaller diameter spring 13, and freely slides over the spring. The length of this larger diameter spring 12 is just less than the inside diameter of the receiving chamber 1, so that it may rest comfortably across the area of the receiving chamber 1 of which the spring passes. The smaller diameter spring 13 is about three times as long as the spring of larger diameter. The reason being that this spring 13 accommodates the tension placed on the spring assembly 2 as it is stretched over the spring support 10. It is also this spring 13 of the spring assembly 2 that is used for retrieving lightweight practice balls. The spring 13 of small diameter is joined together at both its ends with the larger spring, slipping freely on it. To make a neat assembly the larger diameter spring 12 is telescoped over the connection of the ends of the smaller diameter spring 13, whereby the latter assumes a semi-circular appearance.

The spring 12 is necessary to the assembly to enable the device to accommodate regular golf balls effectively. It provides the necessary strength to keep the stack of regulation balls in the barrel 3 from escaping back out the receiving chamber 1. This is no problem with the plastic balls because the spring 13 of smaller diameter provides sufficient strength to maintain the stack of lightweight balls in the barrel 3.

In using the invention, a person must first position the appropriate segment of the spring assembly 2 across the ball receiving chamber 1, and place the opposite segment over the spring support 10. This can be done very quickly and very easily for there is very little tension on the spring assembly 2, and also because the spring assembly 2 is the only movable part involved.

Regulation golf balls require the placement of the spring 12 across the ball receiving chamber 1, because the spring 13 will not adequately support the weight of the balls as they stack up in the barrel 3.

After the spring assembly 2 has been positioned, a person grasps the handle 4, and begins to retrieve balls by pressing the device downward thereonto; the ball as it enters the receiving chamber 1, forces the spring assembly 2 to the side of the chamber nearest the spring, and enters the barrel 3. After the ball enters the barrel region 3, the spring assembly 2 assumes its original position, and is ready to engage the next ball to be retrieved. This action of the assembly 2 is the same for either segment of the spring assembly 2 which might be positioned for use across the ball receiving chamber 1. Which segment of the spring assembly 2 that is positioned across the ball receiving chamber 1 is dependent upon the type of ball one chooses to practice with.

As more balls are retrieved they stack up in the barrel 3 until it becomes full, and then with more balls forced into it, they drop from the open-top of the barrel 3, and begin to fill the basket 5.

The device has a holding capacity of approximately seven dozen balls, which includes sixteen in the barrel 3.

The device may be stored with the balls in the basket 5 in an upright position, or in a position parallel to the ground. Because of the angular design of the basket 5, and the narrow retaining rim at the top edge of the basket 5, very few balls will spill from the device.

After a close scrutiny of the foregoing description, it will readily be seen that I have produced such a device as adequately dictates fulfillment of the objects of the invention as set forth herein.

While this specification sets forth in detail the present and preferred construction of the device, still in practice such deviations from such detail may be resorted to as do not form a departure from the spirit of the invention as defined by the appended claims.

Having thus described my invention, what I claim as new and useful and desire to secure by Letters Patent is:

1. A ball retriever including an upstanding tubular member, the lower end of said tubular member being open and defining a downwardly opening mouth of generally circular cross section, elongated coiled spring means, means anchoring said spring means in position extending across said mouth from one side of said tubular member to the other and with said spring means spaced to one side of a diameter of said mouth paralleling said spring means, said mouth, other than said spring means, being at least substantially free of obstructions to the passage of a ball therethrough of a diameter at least slightly greater than the distance between said spring means and the remote side of said mouth on the other side of said diameter thereof, the lower end of said tubular member including opposite side downwardly opening notches formed therein in which the portions of said spring means adjacent opposite sides of said mouth are seated, said spring means including opposite ends joined together to form an endless spring, said tubular member including means defining an upwardly opening hook on the exterior thereof above said mouth and over which the portion of said spring means remote from the portion thereof extending across said mouth is removably seated.

2. The combination of claim 1 wherein said spring means includes a coiled spring section slidingly telescoped thereon, said spring section being shiftable along said spring means into and out of position on the portion of said spring means extending across said mouth.

3. The combination of claim 1 including an upwardly opening receptacle including a lower bottom wall, the upper end portion of said tubular member being secured through and projecting upwardly above a central portion of said bottom wall.

4. The combination of claim 3 wherein said receptacle includes upwardly divergent side walls.

5. The combination of claim 3 wherein said receptacle includes peripheral side wall portions projecting upwardly from the outer peripheral portion of said bottom wall, the upper marginal portions of said side wall portions including inwardly projecting flange means.

* * * * *